US008893926B2

(12) United States Patent
Anderson et al.

(10) Patent No.: US 8,893,926 B2
(45) Date of Patent: Nov. 25, 2014

(54) APPARATUS AND METHOD FOR CLEANING AND SANITIZING A BEVERAGE DISPENSER

(75) Inventors: Douglas Anderson, St. Charles, IL (US); Karl M. Bogacz, Elk Grove Village, IL (US); Peter S. Tinucci, Wheaton, IL (US); N Sudhir Kumar, Bidar (IN); Ramakrishnan Anoop, Bangalore (IN)

(73) Assignee: Cornelius, Inc., St. Paul, MN (US)

( * ) Notice: Subject to any disclaimer, the term of this patent is extended or adjusted under 35 U.S.C. 154(b) by 435 days.

(21) Appl. No.: 12/924,387

(22) Filed: Sep. 27, 2010

(65) Prior Publication Data

US 2011/0073618 A1 Mar. 31, 2011

Related U.S. Application Data

(60) Provisional application No. 61/277,719, filed on Sep. 29, 2009.

(51) Int. Cl.
*B67D 1/08* (2006.01)
*B67D 1/07* (2006.01)

(52) U.S. Cl.
CPC ..... *B67D 1/07* (2013.01)
USPC ..... 222/148; 222/129.1; 222/146.6; 222/135; 62/342

(58) Field of Classification Search
USPC ..... 222/148, 129.1, 146.6, 1, 135; 62/342
See application file for complete search history.

(56) References Cited

U.S. PATENT DOCUMENTS

| | | | | |
|---|---|---|---|---|
| 3,036,741 | A * | 5/1962 | Hilts | 222/148 |
| 3,995,770 | A * | 12/1976 | Schwitters | 222/56 |
| 4,527,585 | A * | 7/1985 | Mirabile | 137/240 |
| 4,572,230 | A * | 2/1986 | Mirabile | 137/240 |
| 4,582,226 | A * | 4/1986 | Doak | 222/148 |
| 4,592,490 | A * | 6/1986 | McMichael | 222/129.1 |
| 4,615,466 | A * | 10/1986 | Credle, Jr. | 222/129.1 |
| 4,753,372 | A * | 6/1988 | Pocock et al. | 222/148 |
| 4,793,520 | A * | 12/1988 | Gerber | 222/145.2 |
| 4,921,149 | A | 5/1990 | Miller et al. | |
| 4,923,093 | A * | 5/1990 | Gerber | 222/145.2 |
| 4,941,593 | A * | 7/1990 | Hicks et al. | 222/148 |
| 5,090,440 | A * | 2/1992 | Ladouceur et al. | 137/209 |
| 5,799,832 | A * | 9/1998 | Mayo | 222/135 |
| 6,935,532 | B2 | 8/2005 | Tinucci et al. | |
| 6,964,351 | B2 | 11/2005 | Jablonski et al. | |
| 7,293,675 | B1 * | 11/2007 | Luhn | 222/148 |
| 8,459,176 | B2 * | 6/2013 | Nevarez et al. | 99/275 |
| 2008/0149655 | A1 * | 6/2008 | Gist et al. | 221/1 |

* cited by examiner

*Primary Examiner* — Kevin P Shaver
*Assistant Examiner* — Nicholas J Weiss
(74) *Attorney, Agent, or Firm* — Andrus Intellectual Property Law, LLP

(57) ABSTRACT

An apparatus for and method of cleaning and sanitizing a beverage dispenser is characterized by fluid connectors that may quickly and conveniently be manually fluid coupled with either supplies of beverage components to be delivered through flow paths to beverage dispensing valves or with a source of cleaning and sanitizing fluid to be delivered through the flow paths to the beverage dispensing valves to clean and sanitize the flow paths and dispensing valves. The beverage component supplies have valves with which the fluid connectors fluid couple, and a manifold has an inlet port for receiving cleaning and sanitizing fluid and outlet ports that are each located in proximity to an associated beverage component supply valve and with which the fluid connectors may be fluid coupled after being de-coupled from their associated beverage component supply valves.

9 Claims, 6 Drawing Sheets

APPARATUS AND METHOD FOR CLEANING AND SANITIZING A BEVERAGE DISPENSER

This application claims benefit of provisional application Ser. No. 61/277,719, filed Sep. 29, 2009.

FIELD OF THE INVENTION

The present relates to beverage dispensing systems, and in particular to cleaning and sanitizing beverage dispensing systems.

BACKGROUND OF THE INVENTION

Beverage product dispensing systems, such as beverage or drink dispensers, usually have supply containers of liquid beverage components that are fluid coupled through fluid flow paths to dispense valves located at stations where the beverage components are to be dispensed as drinks for service to customers. The beverage components may comprise beverage concentrates or syrups and one or more diluents, such as plain and/or carbonated water, for mixture with the concentrates or syrups to provide a desired beverage. The beverage components are normally chilled, so that drinks drawn for customers are sufficiently cold and not degraded in quality by excessive melting of ice. Chilling of the beverage components can be accomplished in any suitable manner, such as by refrigerating an interior of a cabinet in which supplies of beverage components are stored or by flowing the beverage components through a cold plate before they are delivered to a dispense point. The supplies of beverage components can be located near or relatively far from the dispenser. They can be located in a lower part of the dispenser, in which case pumps can be used to deliver beverage components from the supplies and through flow paths to dispense points, such as to individual ones of a plurality of beverage dispensing valves. One such beverage dispenser having dispense valves for being fluid coupled to supplies of liquid beverage components is taught by U.S. Pat. No. 6,935,532, the teachings of which are incorporated herein by reference. Other types of drink dispensers include smoothie machines.

Upon replacing a depleted supply container of a beverage component, cleaning and sanitizing of the flow path between the container and point of dispense is normally required, particularly if one type of beverage component is being replaced with another type. Cleaning and sanitizing the flow paths may also be required if the beverage dispenser is to be moved from one location to another, and in any event it is required to be performed on a regular basis, usually weekly, for health and sanitation reasons. With conventional beverage dispensing systems, the cleaning and sanitizing operation is normally a tedious and time consuming process.

OBJECT OF THE INVENTION

A primary object of the present invention is to provide a system for and method of quickly and conveniently cleaning and sanitizing fluid flow paths of a beverage dispenser.

SUMMARY OF THE INVENTION

In accordance with the present invention, a beverage dispensing system comprises a plurality of beverage component supply containers each having a valve; a plurality of beverage dispense valves; a manifold having a plurality of outlet ports each in proximity to the valve of an associated one of the supply containers, said manifold also having an inlet port for fluid coupling to a source of cleaning fluid; and a plurality of fluid flow paths each having one end movable between and for being releasably fluid coupled to either the valve of an associated one of the supply containers or to the manifold outlet port associated with that supply container, and an opposite end fluid coupled to an associated one of the dispense valves, so that when the one end of a flow path is fluid coupled to its associated supply container valve, beverage component is delivered through the flow path to its associated dispense valve, and when the one end is disconnected from its associated supply container valve and fluid coupled to its associated manifold outlet port, cleaning fluid is delivered through the flow path to its associated dispense valve to clean the flow path and dispense valve.

In a preferred embodiment of the beverage dispensing system, the one end of each flow path has a tubular member, each manifold outlet port has a valve, and the manifold outlet port valves and supply container valves each have a passage therethrough in which is a deformable wall having an X-shaped slit that normally closes the passage to a flow of fluid therethrough and through which passage and X-shaped slit the tubular member of an associated one of the flow paths can move to open the passage for a flow of fluid therethrough and through the flow path. The one end of each flow path can comprise an elbow connector having the tubular member; the manifold can comprise a plurality of manifolds each having a plurality of outlet ports and an inlet port, with the manifolds being positioned such that each outlet port is adjacent to an associated individual one of the supply container valves; and the manifold can be a plurality of manifolds each having a pair of outlet ports and an inlet port and each being positioned between an associated adjacent pair of the supply container valves with its manifold outlet ports each being toward an associated one of the pair of valves. The beverage dispenser can be a frozen product dispenser having at least one beverage blending station, in which case the beverage dispenser advantageously includes a further flow path having one end fluid coupled to the source of cleaning fluid and an opposite end fluid coupled to at the least one blending station for delivery of cleaning fluid through the further flow path to the at least one blending station to clean the blending station. A plurality of pumps, each fluid coupled to an associated one of the flow paths, can deliver beverage components and cleaning fluid through the flow paths to the dispense valves.

The invention also contemplates a method of operating a beverage dispenser, which comprises the steps of providing a plurality of beverage component supply containers each having a valve; positioning a manifold having a plurality of outlet ports such that each outlet port is in proximity to the valve of an associated one of the supply containers, the manifold also having an inlet port for fluid coupling to a source of cleaning fluid; extending a plurality of fluid flow paths between the supply containers and the dispense valves, each flow path having one end movable between the valve of an associated one of the supply containers and the manifold outlet port associated with that supply container and an opposite end fluid coupled to an associated one of the dispense valves; moving the one end of a flow path into fluid coupled relationship with the valve of its associated supply container to deliver beverage component from the supply container and through the flow path to its associated dispense valve; and thereafter moving the one end of a flow path into fluid coupled relationship with its associated manifold outlet port to deliver cleaning fluid through the flow path to its associated dispense valve to clean the flow path and dispense valve.

According to a preferred practice of the method, the step of moving the one end of a flow path into fluid coupled relationship with its associated manifold outlet port comprises first removing the one end of such flow path from fluid coupled relationship with its associated supply container valve and then moving the one end into fluid coupled relationship with its associated manifold outlet port. Alternatively, the step of moving the one end of a flow path into fluid coupled relationship with the valve of its associated supply container comprises first removing the one end of such flow path from fluid coupled relationship with its associated manifold outlet port and then moving the one end of the flow path into fluid coupled relationship with the valve of its associated supply container. It is contemplated that the one end of each flow path have a tubular member, each manifold outlet port have a valve, and the manifold outlet port valves and supply container valves each have a passage therethrough in which is a deformable wall having an X-shaped slit that normally closes the passage to a flow of fluid therethrough, with the moving step then comprising moving the tubular member through the passage and X-shaped slit of either a supply container valve or a manifold outlet port valve. The one end of each flow path can comprise an elbow connector having the tubular member, and each supply container valve and manifold outlet port valve can be an LMS valve. The manifold can be a plurality of manifolds each having a pair of outlet ports and an inlet port, and the positioning step positions each manifold between an associated adjacent pair of supply container valves with each manifold outlet port being toward an associated one of the supply container valves of the associated pair, and the step can be included of merging the manifold inlet ports together into a single inlet for connection to the source of cleaning liquid. Should the beverage dispenser be a frozen beverage dispenser having a blending station, then the method also provides the steps of extending a further fluid flow path between the source of cleaning fluid and the blending station; and delivering cleaning fluid through the further flow path to the blending station to clean the blending station.

The foregoing and other objects, advantages and features of the invention will become apparent upon a consideration of the following detailed description when taken in conjunction with the accompanying drawings.

Figure 1:
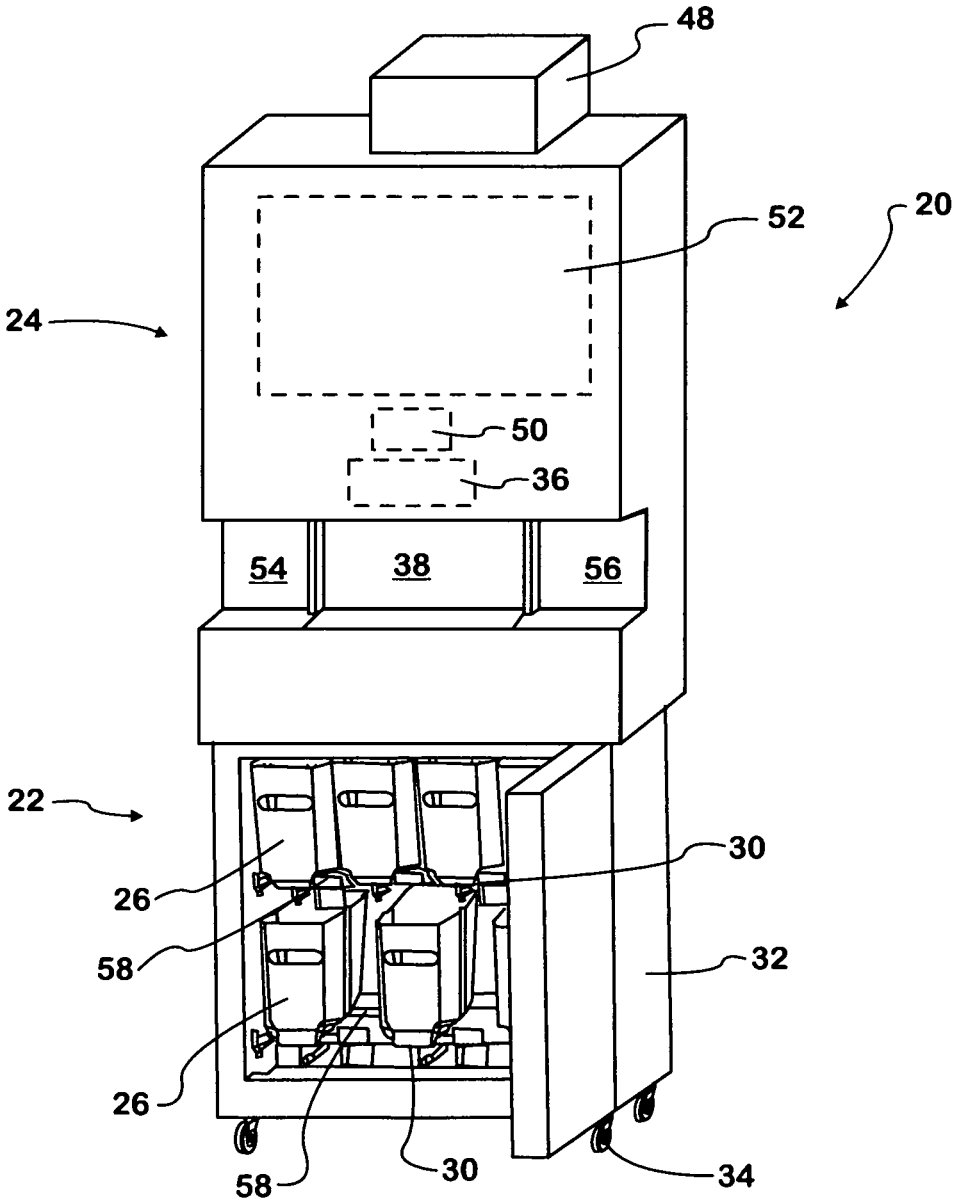
FIG. 1 is a perspective view of a beverage dispenser, which as depicted is a smoothie machine.

DETAILED DESCRIPTION:

FIG. 1 shows a beverage dispensing machine, indicated generally at 20, which for the purpose of illustrating the present invention will be described as a smoothie dispensing machine. It is to be understood, however, that the dispensing machine need not necessarily be a smoothie machine, but could be a different type of beverage dispensing machine, such as a conventional beverage dispenser for dispensing soft drinks for service to a customer.

Figure 2A:
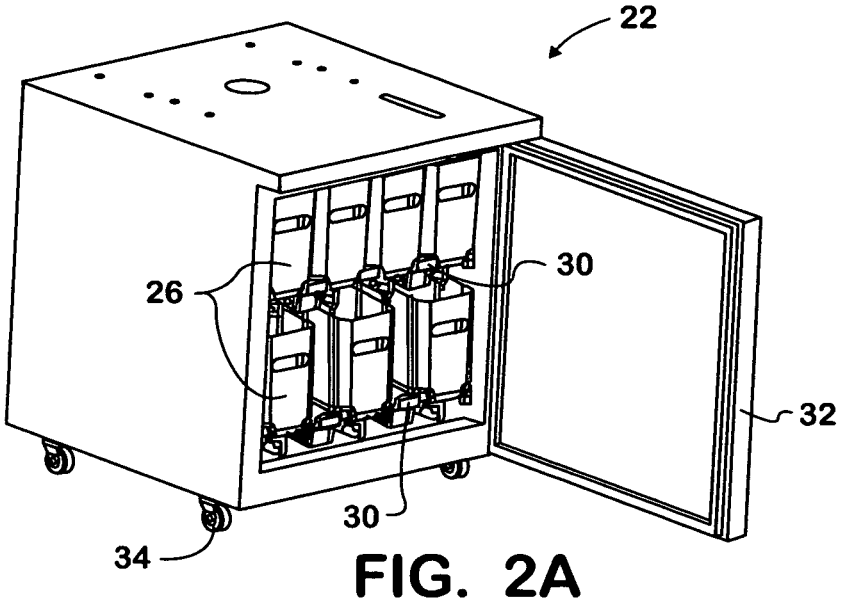
FIG. 2A is a perspective view of a lower cabinet of the beverage dispenser of FIG. 1, for storing supply containers of liquid beverage components that are disposed in bins carried on shelves in the cabinet.
Figure 2B:
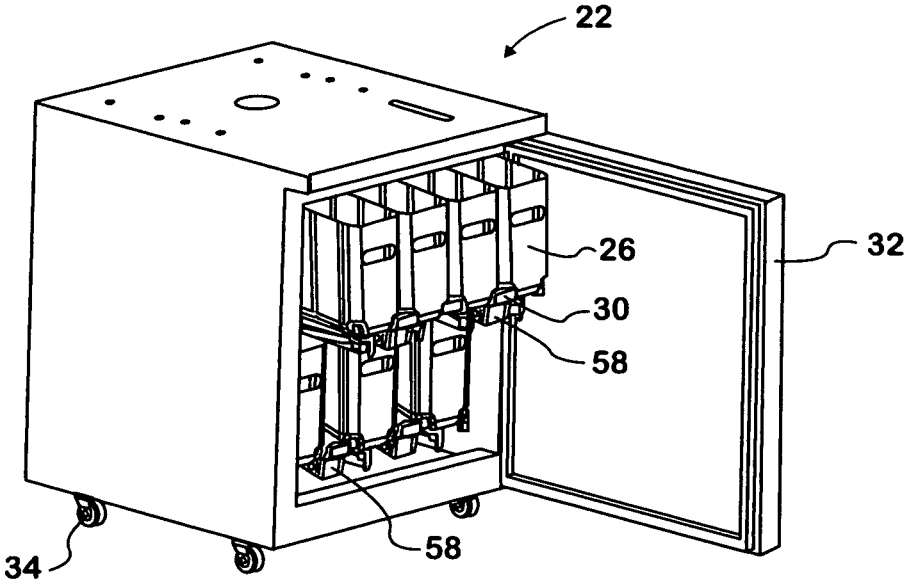
FIG. 2B is similar to FIG. 2A and shows a top shelf of the cabinet slid out to provide access to bins carried by the shelf.
Figure 3:
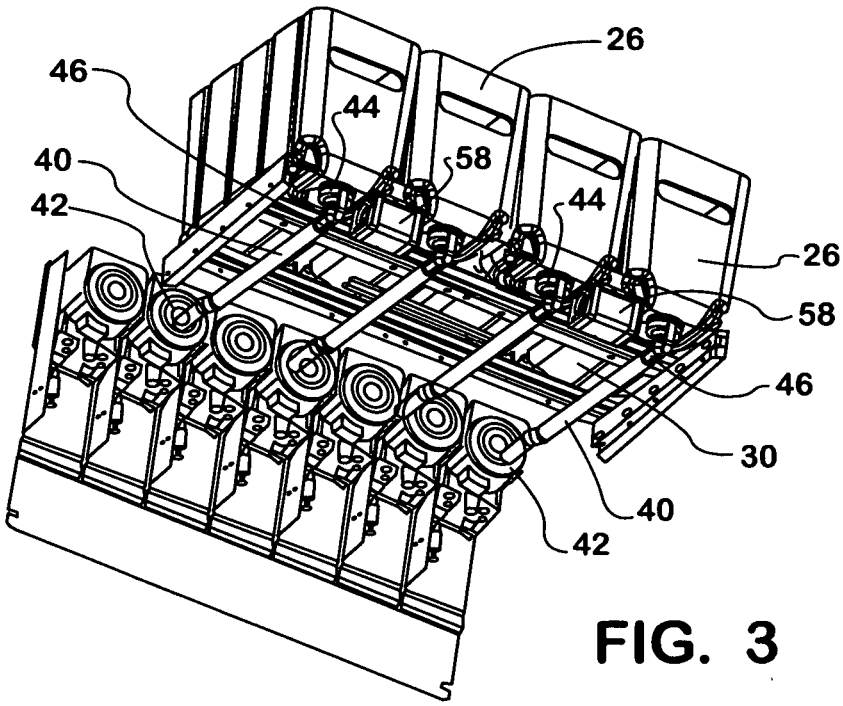
FIG. 3 is a perspective view looking up and showing bins carried on a shelf of the lower cabinet and fluid connections made to outlet valves of beverage component supply containers disposed in the bins.
Figure 4:
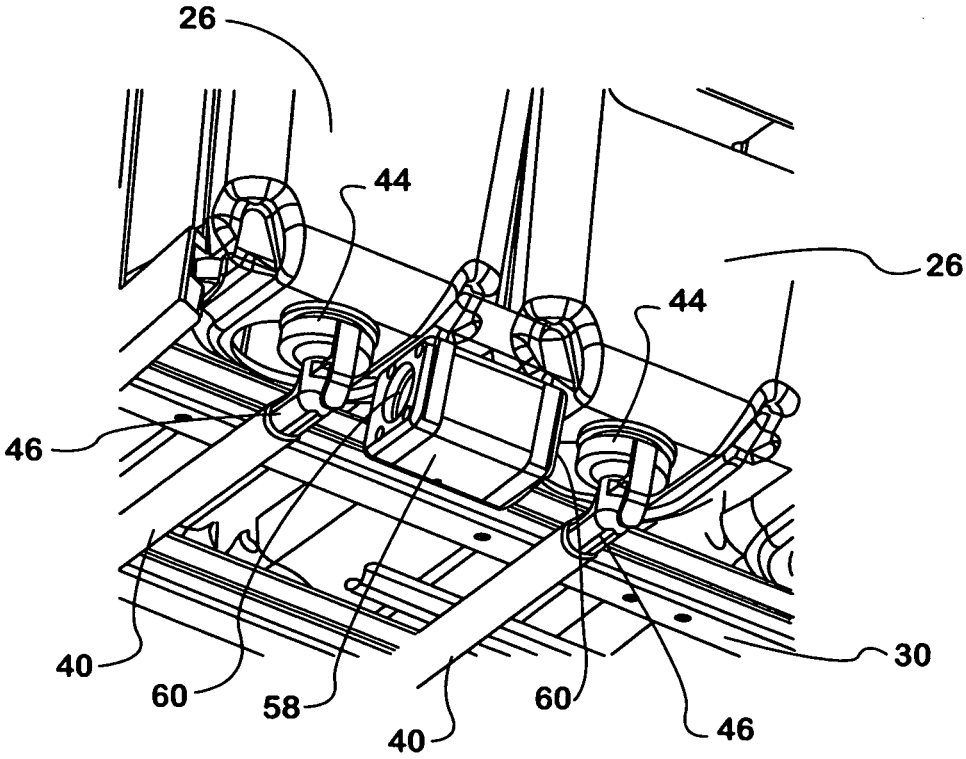
FIG. 4 is a perspective view looking up and showing elbow connectors fluid coupled to the outlet valves of the beverage component supply containers in the bins and a sanitizing manifold to which the elbow connectors are fluid coupled when beverage component flow paths are to be cleaned and sanitized.
Figure 5:
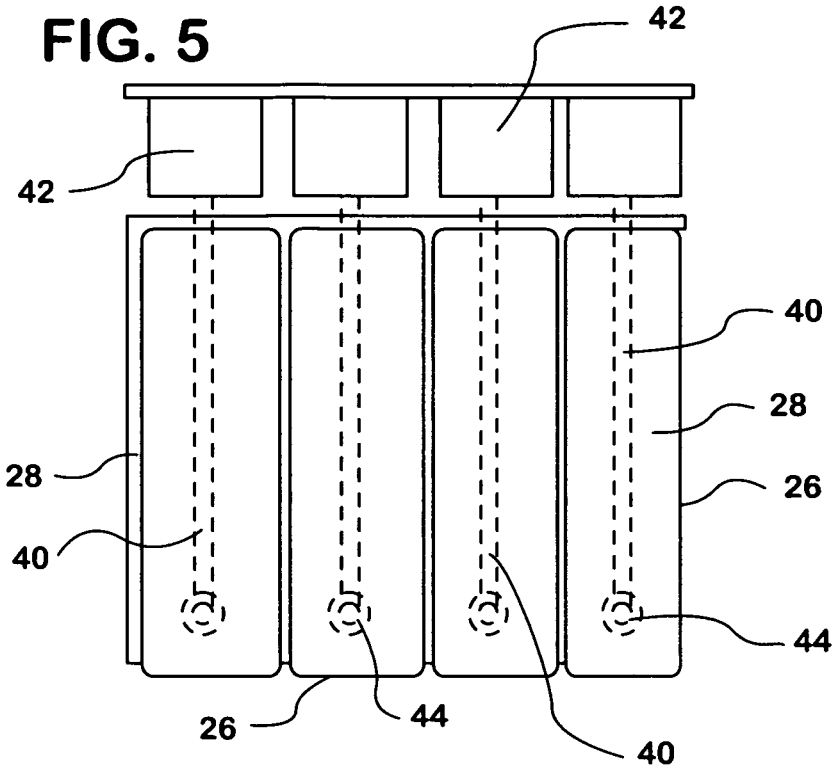
FIG. 5 shows fluid connections made to the outlet valves of the beverage component supply containers in the bins.
Figure 6:
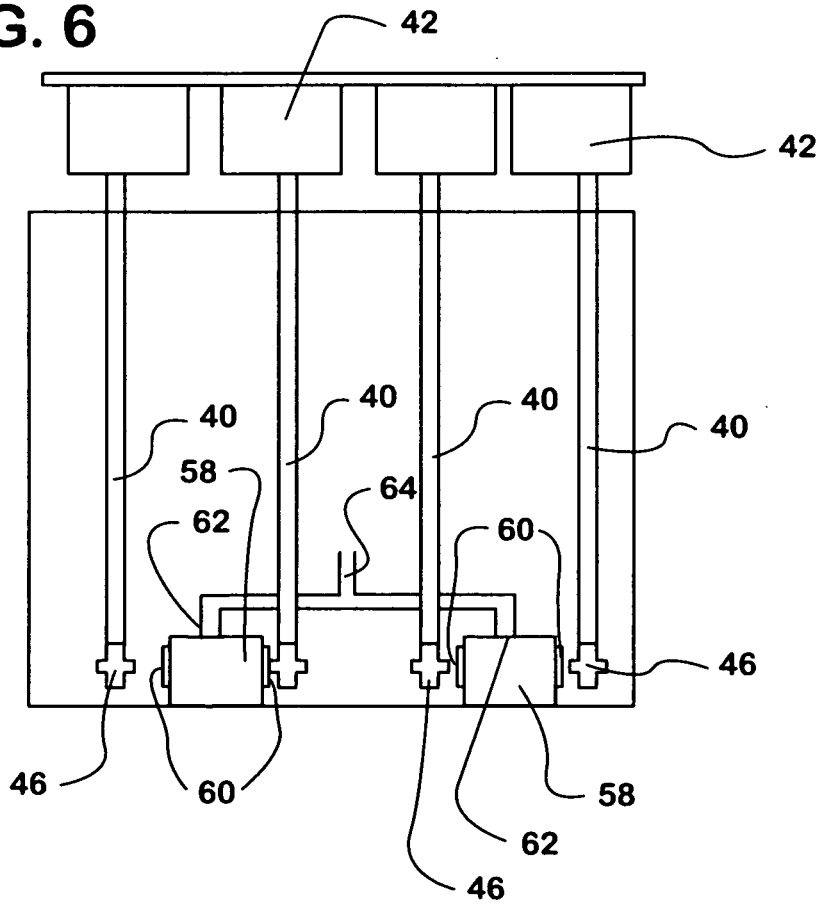
FIG. 6 shows the elbow connectors disconnected from the beverage component supply container outlet valves and positioned to be connected to outlet ports of manifolds to accommodate flowing a cleaning and sanitizing fluid through the beverage component flow paths.

With reference also to FIGS. 2A and 2B, the beverage dispenser 20 includes a lower cabinet, indicated generally at 22 and on top of which is supported an upper beverage dispensing cabinet of the machine, indicated generally at 24. Alternatively, the lower cabinet can be separate from the upper cabinet, for example by being placed below a countertop on which the upper beverage dispensing cabinet is supported. Within the lower cabinet 22 is a plurality of bins 26 in which are disposed associated individual ones of a plurality of supply containers or bags 28 (FIG. 5) of liquid beverage components. The bins are carried on shelves 30 that can be fixed in place in the cabinet 22 or, for more convenient access to the bins and bags, the shelves can be mounted for sliding movement into and out of the cabinet to make it easier to access and replace depleted bags of beverage components with fresh bags. As shown, there are 2 shelves and 7 bins, 4 bins on a top shelf and 3 bins on a bottom shelf. However, depending upon the number of bags 28 of beverage components to be stored in the cabinet 22, the cabinet can be appropriately sized to accommodate more or fewer shelves and more or fewer bins carried on the shelves. Opposite sides of the shelves are supported by opposite side walls of the cabinet and, in the case of slidable shelves, are slidably carried on rails mounted to the side walls. A door 32 is hinged to a front of the cabinet for movement between positions opening and closing the cabinet and casters 34 can be provided on the bottom of the cabinet to facilitate its movement on a floor.

The beverage components in the bags 28 can be beverage concentrates and/or syrups, in which case diluent that can be plain and/or carbonated water is normally provided for mixing with the concentrates and/or syrups to prepare beverages for service to customers. Dispense valves 36 are in the upper cabinet 24 above a drink dispense station 38. With reference also to FIGS. 3-6, the beverage components in the bags 28 are delivered to the dispense valves through associated fluid flow paths, each of which includes a tubing 40 fluid coupled at one end to beverage component in an associated bag 28 and fluid coupled at an opposite end to an associated pump 42 that delivers the beverage component from the bag to an associated one of the dispense valves 36.

The supply bags 28 of beverage components each have an outlet valve that can be an LMS (Liquid Molding System) valve 44, which is understood by those of skill to be a valve having a passage extending therethrough and in which passage there is a silicon member having an X-shaped or "+" shaped cut that normally closes the passage, but into which passage and through which "+" shaped cut a fluid connector can be moved to establish fluid communication with the beverage component in the bag interior. For the arrangement shown, fluid connectors for coupling with the valves 44 are elbow connectors 46, each of which connector has a tubular outlet fluid coupled to one end of an associated tubing 40, an opposite end of which tubing is fluid coupled to an associated pump 42. Each elbow connector also has a tubular inlet for coupling with an associated valve 44 by means of manually moving the tubular inlet into the valve passage and through the "+" shaped cut in the silicon member in the passage into fluid coupled relationship with the liquid contents in the interior of the associated bag 28. The elbow connector tubular inlet may also be manually removed from the valve passage "+" shaped cut therein to disconnect the elbow connector from the bag interior. Thus, with the elbow connector in fluid communication with the interior of its associated bag, operation of its associated pump 42 draws beverage component from the bag and through the elbow connector and tubing for delivery to the dispense valves 36 in the upper cabinet 24. As is apparent, the fluid coupling arrangement with the beverage components in the bags 28 accommodates convenient replacement of a depleted bag, since the elbow connector for a depleted bag can simply be manually withdrawn from the valve 44 of the bag, whereupon the depleted bag can be lifted out of its bin 26 and replaced with a fresh bag that is then fluid coupled to the elbow connector via its own valve 44.

The liquid beverage components and diluents are delivered through flow paths that extend between the bags 28 of beverage components in the lower cabinet 22 and the beverage dispense valves 36 in the upper cabinet 24. To ensure that quality beverages are dispensed for service to customers, means are provided for chilling the beverage components and any diluents delivered to the dispense valves. One such means can comprise a refrigeration system 48 mounted on the upper cabinet 24 for chilling the interior of the lower cabinet 22 in which the bags of beverage components are stored. For the case where the beverage dispenser 20 is a smoothie machine 20 that also dispenses ice from an ice dispenser 50 located in the upper cabinet 24 above the dispense station 38, the refrigeration system can service an icemaker (not shown) that manufactures ice for introduction into an ice storage hopper 52 for delivery from the hopper to the ice dispenser, or a separate refrigeration system can be provided for the icemaker. The chilling means can also include a cold plate that is contacted by ice and through fluid circuits of which beverage components and diluents are flowed prior to being delivered to the dispense valves 36. Means (not shown) may also be provided to chill the flow paths themselves between the lower cabinet 22 and the dispense valves 36 in the upper cabinet 24. The ice dispenser or chute 50 may be of a type as disclosed in either U.S. Pat. No. 6,964,351, issued Nov. 15, 2005, or in U.S. Pat. No. 4,921,149, issued May 1, 1990, the teachings of which patents are specifically incorporated herein by reference. The refrigeration system may be of a type as disclosed in pending U.S. patent application Ser. No. 11/974,061, filed Oct. 11, 2007 and published on Jun. 26, 2008 as Publication No. US 2008/0149655, the teachings of which are specifically incorporated herein by reference.

The smoothie machine 20 includes at least one and preferably two drink blending stations 54 and 56, at each of which mixers or blenders are provided for blending beverage ingredients into smoothie drinks for service to customers. In the preparation of a beverage, a container is placed at the dispense station 38 and beneath the dispense valves 36 and ice dispenser 50, whereupon the dispenser is operated to dispense predetermined quantities of beverage components and ice into the container. The container is then moved to one of the blending stations 54 and 56 where a blending mechanism, such as a blender or rotary mixer, is brought into contact with the beverage ingredients in the container and operated for a time necessary to blend the ingredients into a smoothie for service to a customer.

As is understood by those skilled in the art, in the preparation of drinks it is desirable to prevent cross-contamination of different beverage components such as base beverages, syrups, concentrates and/or additive flavors, etc. It also is necessary, indeed required, that all flow paths through a beverage dispenser that are contacted by beverage ingredients be cleaned and sanitized periodically, usually at no more than weekly intervals. This entails thoroughly cleaning all of the tubing, pumps, valves, solenoids, etc., contacted by the beverage components and through which beverage components are flowed, as well as any other parts of the beverage dispenser that the beverage components contact in the preparation of drinks for service to customers. Also, in the case of changing a type of beverage component to be delivered through a particular flow path, to avoid cross contamination the flow path must be first cleaned. Conventional techniques for cleaning and sanitizing a beverage dispenser can be labor intensive and time consuming.

To facilitate cleaning and sanitizing of the beverage component flow paths of the beverage dispensing machine 20, the invention provides a novel apparatus for and method of quickly and conveniently flowing cleaning and sanitizing liquid through a selected one or more or all of the flow paths, which includes the tubes, valves, pumps and any other components that are contacted by the beverage components as they are delivered from the supply bags 28 in the lower cabinet 22 to the dispense valves 36 in the upper cabinet 24. The invention also provides for cleaning and sanitizing the blenders used to blend the beverage components into a smoothie drink at the blending stations 54 and 56.

When there is a need to clean and sanitize the beverage dispenser, one or more and perhaps all of the flow paths carrying beverage product and that are fluid coupled via their elbow connectors 46 to beverage component supply bags 28 are disconnected from the valves 44 of the bags. The elbow connectors of such flow paths are then fluid coupled to associated outlet ports of a manifold that may have a plurality of outlet ports and that also has an inlet port connected to a source of cleaning and sanitizing fluid. A plurality of such manifolds can be used, in which case the inlet ports to the manifolds may be merged into a single inlet that is coupled to the source of cleaning and sanitizing fluid. The various pumps 42 associated with the flow paths to be cleaned and sanitized are then operated either individually or simultaneously to flow the cleaning and sanitizing fluid from the manifold outlets into and through the flow paths to and out of the dispense valves 36, thereby to clean and sanitize the entirety of the flow paths. A separate pump may be used to flow the cleaning and sanitizing fluid through the blenders to clean and sanitize the same.

With reference also to FIGS. 3-6, to implement the cleaning and sanitizing process a plurality of manifolds 58 are carried on a bottom surface of and toward the front of each shelf 30 in the lower cabinet 22. Each manifold is located between an associated pair of bins 28 supported by the shelf and also between an associated pair of valves 44 of the beverage component supply bags 28 carried in the bins. Each manifold has a pair of outlet ports 60 on its opposite sides and an inlet port 62 fluid coupled to a source (not shown) of cleaning and sanitizing fluid. Each manifold outlet port faces an associated one of the associated pair of valves 44, and where a plurality of manifolds are carried on a single shelf 30, their inlet ports 62 can be fluid coupled together and merged into a single line 64 (FIG. 6) leading to the source of cleaning and sanitizing fluid. If desired, the plurality of manifolds on a single shelf can be replaced with a single manifold having an inlet port and a plurality of outlet ports, with each outlet port being located in proximity to an associated one of the valves 44 of the beverage component supply bags 28 carried in the bins on the shelf. The manifold inlet ports 60 are provided with valves for fluid coupling with the elbow connectors 46, which manifold outlet port valves may be the same as the valves 44 of the bags 28.

To quickly and conveniently clean and sanitize the flow paths between one or more or all of the elbow connectors 46 and the dispense station 38, for each flow path to be cleaned and sanitized, its associated elbow connector is pulled out of and disconnected from the valve 44 of its associated beverage component supply bag 28 and is then inserted into and fluid coupled with the valve in its associated outlet port 60 of its associated manifold 58. The pumps 42 associated with the elbow connectors 46 that are fluid coupled with the manifold outlet ports 60 are then operated to deliver cleaning and sanitizing fluid from the source thereof and through the manifolds, elbow connectors and associated flow paths to and through the dispense valves 36 at the dispense station to clean and sanitize the flow paths. After cleaning and sanitizing is complete, the elbow connectors 46 are pulled out of and disconnected from the manifold outlet port valves and reconnected to the valves 44 of their associated beverage component supply bags 28, which bags may be either the same as or different from the bags with which the elbow connectors were previously fluid coupled.

Figure 8:
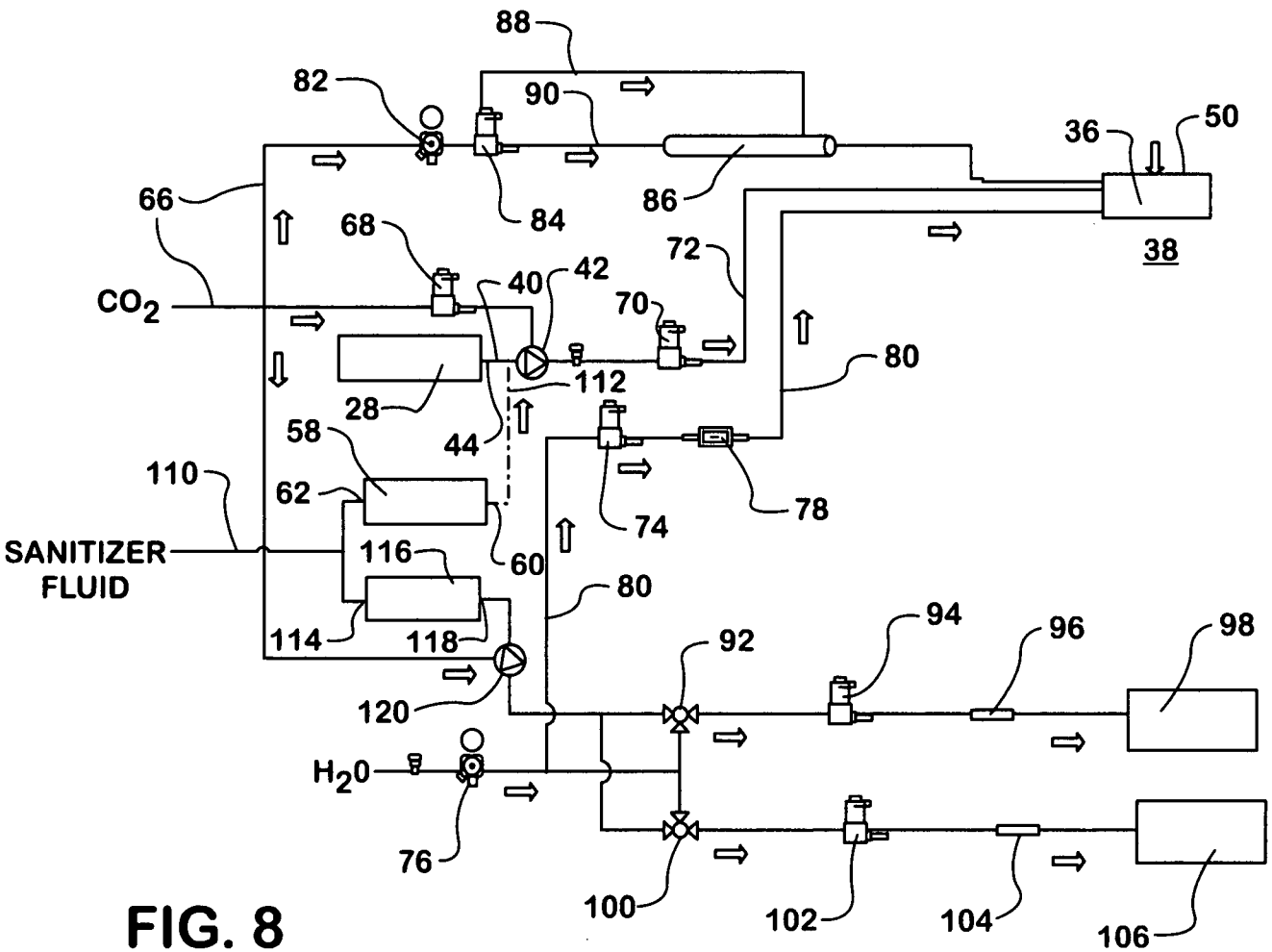
FIG. 8 is a schematic representation of the fluid circuits of the beverage dispenser, including those used in cleaning and sanitizing the beverage component flow paths of the dispenser.

The fluid circuits of the beverage dispensing machine 20 are schematically shown in FIG. 8. While only those fluid flow paths associated with delivery of liquid beverage component from just a single one of the supply bags 28 to the dispense valves 36 are shown, it is understood that similar fluid circuits exist for delivery of beverage components from the other bags. To begin, each beverage component supply bag 28 is fluid coupled via its valve 44, elbow connector 46 and tubing 40 to its associated pump 42. The pump may be $CO_2$ operated, and for the purpose is provided with a pressure regulated supply of $CO_2$ through a line 66 and a solenoid valve 68. To deliver liquid beverage component from the bag 28 to the dispense valves 36 at the dispense station 38 in the upper cabinet 24, the solenoid valve 68 is opened to deliver $CO_2$ to the pump 42 to operate the pump and a solenoid valve 70 is opened to establish a flow path from the pump to the dispense valves through a line 72, whereby the pump delivers beverage component from the bag to the dispense valves. At the same time, to deliver a diluent for the beverage component to the dispense valves 38, a solenoid valve 74 is opened for flow of water from a supply thereof through a pressure regulator 76, the solenoid valve, a flow control 78 and a line 80 to the dispense valves. When the desired quantities of beverage component and diluent have been delivered to and through the dispense valves, the respective solenoid valves 68 and 74 are closed.

Ice is an ingredient of a smoothie beverage and means are provided to control the ice dispenser 50 to deliver a desired quantity of ice into a container at the dispense station 38. The ice dispenser 50 includes an ice chute gate (not shown), and to control opening and closing of the gate, $CO_2$ is delivered through a pressure regulator 82 and a solenoid valve 84 to a pneumatic cylinder 86. A piston (not shown) is movable in the cylinder and is coupled to the ice chute gate to either open the gate for dispensing of ice from the hopper 52 and through the chute to the dispense station 38 or to close the gate to terminate ice dispense. The direction of movement of the piston in the cylinder, and therefore whether the ice chute is opened or closed, depends upon whether the solenoid valve 84 is controlled to deliver $CO_2$ through a line 88 into one end of the cylinder 86 on one side of the piston or through a line 90 into an opposite end of the cylinder on the other side of the piston. In operation, the solenoid 84 advantageously is operated to open the ice chute gate for a time selected to deliver a predetermined quantity of ice into a container at the dispense station 38 below the ice dispenser. After the beverage component, water and ice are delivered in predetermined quantities into the container at the dispense station, the container is moved to one of the blending stations 54 and 56 where a motor driven blender is moved through the ingredients in the container to blend the same into a smoothie beverage for service to a customer.

Figure 7:
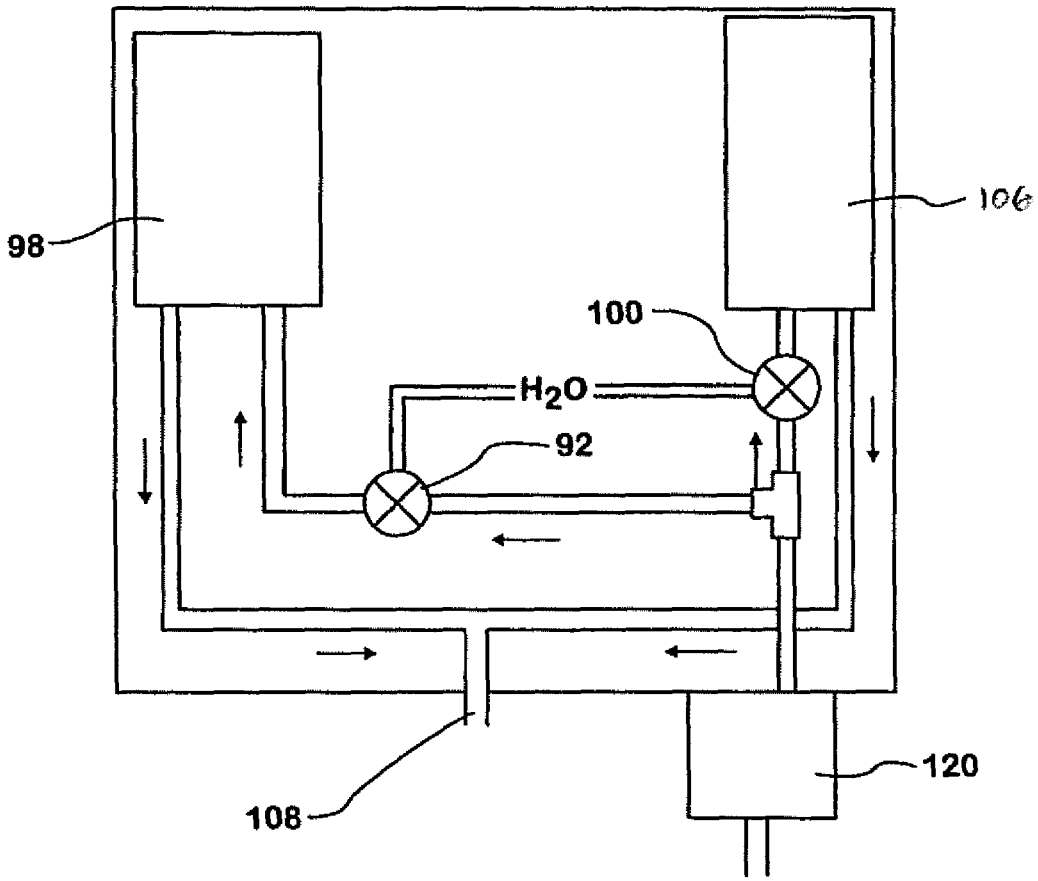
FIG. 7 shows the manner in which a cleaning and sanitizing solution flows through blenders of the smoothie machine.

After blending of the beverage components into a smoothie is complete, the blender must be cleaned before it is again used. Cleaning of the blender is accomplished by flowing water through either a 3-way valve 92, a solenoid valve 94 and an orifice 96 to a blender 98 at the blending station 54, or through a 3-way valve 100, a solenoid valve 102 and an orifice 104 to a blender 106 at the blending station 56, depending upon which blender was used and requires cleaning. As seen in FIG. 7, if sanitizing is not required, just water can be used to clean the blender, with the water flowing out of the blender through a drain line 108.

When a liquid beverage component is changed from one type to another, such as from one flavor to another, or when it otherwise becomes necessary to clean and sanitize the beverage component flow paths through the beverage dispensing machine 20, one or more or all of the elbow connectors 46 are removed from their fluid connections with the valves 44 of the beverage component supply bags 28 and are fluid coupled to the valves for their associated manifold outlet ports 60, as represented by the dashed fluid flow line 112. The cleaning and sanitizing fluid from the source thereof is then delivered through a line 110 to the inlet ports 62 to the manifolds 58. The solenoid valves 68 and 70 are then opened so that the pumps 42 operate to deliver cleaning and sanitizing fluid from the source thereof through the manifolds 58, the elbow connectors 46 and the beverage component flow paths that extend from the elbow connectors to and through the dispense valves 36 to clean and sanitize the same. During such cleaning and sanitizing operation, the dispense valves 36 are maintained opened to accommodate a flow of cleaning and sanitizing fluid therethrough and into a collection container placed at the station 38. The cleaning and sanitizing fluid can be flowed through all of the beverage component flow paths simultaneously of through just selected individual ones of the flow paths. When cleaning and sanitizing is complete, the solenoid valves 68 and 70 are closed and the elbow connectors 46 are removed from the outlet port valves of the manifolds 58 for reconnection to the valves 44 of their associated beverage component supply bags 28.

To sanitize the blenders 98 and 106, the cleaning and sanitizing solution supply lie 110 connects to an inlet port 114 to a manifold 116, an outlet port 118 from which is fluid coupled to an inlet to a $CO_2$ powered pump 120. To deliver cleaning and sanitizing solution to a selected one of the blenders 98 and 106, its associated 3-way valve 92 or 100 is operated to deliver the solution to the blender. After cleaning and sanitizing the blender, as shown in FIG. 7 the cleaning and sanitizing solution leaves the blender through the drain line 108. The 3-way valves can be operated such that the blenders are cleaned and sanitized one at a time or simultaneously.

The invention provides an improved apparatus for and method of quickly, efficiently and conveniently cleaning and sanitizing all beverage component flow paths, and all parts of a beverage dispensing machine, that are contacted by beverage components in the preparation of drinks for service to customers. Simply by manually uncoupling a connector from its fluid connection to a supply of beverage component and re-coupling the connector to a source of cleaning and sanitizing fluid, a fluid flow path served by the connector can flushed clean of beverage component and sanitized.

While embodiments of the invention have been described in detail, various modifications and other embodiments thereof may be devised by one skilled in the art without departing from the spirit and scope of the invention, as defined in the appended claims.

What is claimed is:

1. A beverage dispensing machine comprising:

a plurality of supply containers, wherein each container is configured to contain a liquid beverage component;

a container valve on each container for dispensing the liquid beverage component;

a shelf that supports the plurality of supply containers;

at least one dispense valve that is configured to dispense the liquid beverage components from the plurality of supply containers to a user;

a plurality of pumps that are configured to pump the liquid beverage components from the plurality of supply containers to the at least one dispense valve;

a plurality of flexible supply tubes that supplies the liquid beverage components from the plurality of supply containers to the plurality of pumps; wherein each supply tube in the plural iv of flexible supply tubes has a first end and a second, opposite end, wherein the second end is connected to a pump in the plurality of pumps;

at least one manifold for distributing cleaning fluid, the manifold being disposed on the shelf between a pair of containers in the plurality of containers, wherein the manifold comprises opposite sides and a pair of outlet ports located on the opposite sides; and a plurality of adapters on the first ends of the plurality of flexible supply tubes, wherein each adapter is located between one of the container valves and one of the outlet ports, and wherein each adapter is interchangeably connectable to the one of the container valves and the one of the outlet ports;

wherein the manifold further comprises an inlet port that is in fluid communication with the pair of outlet ports, wherein the inlet port configured to receive a cleaning fluid from a source of cleaning fluid;

wherein connecting the plurality of adapters to the plurality of container valves and then operating the plurality of pumps allows for dispensing of the liquid beverage components via the at least one dispense valve; and wherein connecting the plurality of adapters to the outlet ports allows for cleaning of the manifold, plurality of adapters, plurality of flexible supply tubes, plurality of pumps and the at least one dispense valve with the cleaning fluid.

2. The machine according to claim 1, further comprising a cabinet in which the shelf is mounted, wherein the shelf is slideable into and out of the cabinet.

3. The machine according to claim 1, further comprising a plurality of bins for containing the plurality of containers, wherein the shelf supports the plurality of bins.

4. The machine according to claim 3, wherein the manifold is suspended from the shelf below the plurality of bins.

5. The machine according to claim 4, wherein the manifold is one of a plurality of manifolds supported by the shelf, each manifold being disposed between a pair of containers in the plurality of containers, wherein each manifold comprises the opposite sides and further comprises the pair of outlet ports located on the opposite sides.

6. The machine according, to claim 5, wherein the inlet ports of the plurality of manifolds are connected to a single line that receives the cleaning fluid from the source of cleaning fluid.

7. The machine according to claim 6, comprising a drink blending station, and comprising a flow path that fluidly connects one of the manifolds in the plurality of manifolds to the drink blending, station; and further comprising a valve for opening the flow path and supplying the cleaning fluid to the drink blending station at the same time that cleaning, fluid is supplied to the dispense valve.

8. The machine according to claim 1, wherein each of the plurality adapters extends through the shelf and wherein the plurality of flexible supply tubes are located below the shelf and wherein the first end of each supply tube is located adjacent one of the container valves.

9. A beverage dispensing machine comprising:

a plurality of supply containers, wherein each container is configured to contain a liquid beverage component:

a container valve on each container for dispensing the liquid beverage component;

a shelf that supports the plurality of supply containers;

at least one dispense valve that is configured to dispense the liquid beverage components from the plurality of supply containers to a user;

a plurality of pumps that are configured to pump the liquid beverage components from the plurality of supply containers to the at least one dispense valve;

a plurality of flexible supply tubes that extend between the plurality of containers, wherein the plurality of flexible supply tubes supplies the liquid beverage components from the plurality of supply containers to the plurality of pumps; wherein each supply tube in the plurality of flexible supply tubes has a first end and a second, opposite end, wherein the second end is connected to a pump in the plurality of pumps;

at least one manifold for distributing cleaning fluid, the manifold being disposed on the shelf between a pair of containers in the plurality of containers, wherein the manifold comprises opposite sides and a pair of outlet ports located on the opposite sides; and a plurality of adapters on the first ends of the plurality of flexible supply tubes, wherein each adapter is located between one of the container valves and one of the outlet ports, and wherein each adapter is interchangeably connectable to the one of the container valves and the one of the outlet ports;

wherein the manifold further comprises an inlet port that is in fluid communication with the pair of outlet ports, wherein the inlet port configured to receive a cleaning fluid from a source of cleaning fluid; and wherein connecting the plurality of adapters to the plurality of container valves and then operating the plurality of pumps allows for dispensing of the liquid beverage components via the at least one dispense valve;

wherein connecting the plurality of adapters to the outlet ports allows for cleaning of the manifold, plurality of adapters, plurality of flexible supply tubes, plurality of pumps and the at least one dispense valve with the cleaning fluid;

a cabinet in which the shelf is mounted, wherein the shelf is slideable into and out of the cabinet;

a plurality of bins for containing the plurality of containers. wherein the shelf supports the plurality of bins;

wherein the manifold is suspended from the shelf below the plurality of bins;

wherein the manifold is one of a plurality of manifolds supported by the shelf, each manifold being disposed between a pair of containers in the plurality of containers, wherein each manifold comprises the opposite sides and further comprises the pair of outlet ports located on the opposite sides; and wherein the inlet ports of the plurality of manifolds are connected to a single line that receives the cleaning fluid from the source of cleaning fluid; and a drink blending station, and comprising a flow path that fluidly connects one of the manifolds in the plurality of manifolds to the drink blending station; and further comprising a valve for opening the flow path and supplying the cleaning fluid to the drink blending station at the same time that cleaning fluid is supplied to the dispense valve; and wherein each of the plurality of adapters extends through the shelf and wherein the plurality of flexible supply tubes are located below the shelf and wherein the first end of each supply tube is located adjacent one of the container valves.

* * * * *